US008007969B2

(12) United States Patent
Lieberman

(10) Patent No.: US 8,007,969 B2
(45) Date of Patent: Aug. 30, 2011

(54) TRI-LEVEL XEROGRAPHY FOR HYPOCHROMATIC COLORANTS

(75) Inventor: David J. Lieberman, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 646 days.

(21) Appl. No.: 12/135,550

(22) Filed: Jun. 9, 2008

(65) Prior Publication Data

US 2009/0305154 A1 Dec. 10, 2009

(51) Int. Cl.
*G03G 13/01* (2006.01)
*G03G 15/01* (2006.01)

(52) U.S. Cl. ..... 430/45.31; 430/42.1; 399/223

(58) Field of Classification Search ..... 430/42.1, 430/45.31, 54; 399/156, 223, 298
See application file for complete search history.

(56) References Cited

U.S. PATENT DOCUMENTS 5,155,541 A 10/1992 Loce et al.
5,337,136 A 8/1994 Knapp et al.
5,534,990 A 7/1996 Harris
5,892,891 A 4/1999 Dalal et al.
5,895,738 A 4/1999 Parker et al.
6,163,672 A * 12/2000 Parker et al. ..... 399/223
6,188,861 B1 2/2001 Parker et al.
6,203,953 B1 3/2001 Dalal
6,295,431 B1 9/2001 Mashtare et al.
7,734,225 B2 * 6/2010 Mashtare et al. ..... 399/223
2006/0140651 A1 * 6/2006 Hirobe et al. ..... 399/27

OTHER PUBLICATIONS

Braverman et al., "Hue preservation aspects of CMYK—CMYKcm color transformations", *ICIS '06, Int'l Congress of Image Science*, May 7-11, 2006, pp. 637-640.
Co-pending U.S. Appl. No. 11/692,411 to Mashtare et al., filed Mar. 28, 2007.

* cited by examiner

*Primary Examiner* — Mark F Huff
*Assistant Examiner* — Stewart A Fraser
(74) *Attorney, Agent, or Firm* — Oliff & Berridge, PLC

(57) ABSTRACT

A xerogrpahic system and method use a tri-level development process in which at least one xerographic imaging unit includes a photoreceptor and a pair of developer units. A first developer unit includes a conventional first toner of a given color (CYMK) and a second developer unit includes a hypochromatic light form of the first toner. By use of a specific tri-level process, excellent color-to-color registration can be achieved for each processed color separation because overlap between colorants can be prevented. Moreover, by use of two forms of the same colorant, a smoother tone reproduction curve can be achieved when an aggressive blending strategy is used. Gamut loss and ink limit violation can be avoided by adjusting the blending curve in certain situations. An exemplary implementation uses a four drum, eight color tandem architecture with formulations of Cyan, Magenta, Yellow and Black, as well as corresponding hypochromatic light colorants of light Cyan, light Magenta, light Yellow, and light Black (gray).

23 Claims, 11 Drawing Sheets

TRI-LEVEL XEROGRAPHY FOR HYPOCHROMATIC COLORANTS

BACKGROUND

A novel xerographic system architecture and methodology affords the opportunity to achieve smoother halftones in light critical areas while alleviating ink-limit stress through use of a tri-level process and one or more hypochromatic light colorants.

Photographic quality inkjet printers have, for a number of years, taken advantage of light colorant strength ink capability to significantly drive down image noise levels for highlight/midtone areas, particularly for fleshtone and blue sky regions, for example. However, the ability to achieve a similar advantage with current xerographic platforms is difficult due to the difficulties associated with designing halftone screens for more than 4 distinct colors on xerographic systems with color misregistration issues, and other xerographic process limitations, such as ink limits and prohibitive cost of consumables.

Some commercial products achieve printing using light hypochromatic colorants. However, such products require interlaced halftone screens that require extremely tight registration requirements of about 10 microns to enable dot-on-dot halftoning. This multipass marking engine struggles to achieve this level of accuracy and is susceptible to objectionable registration induced color shifts. Many other architectures, particularly single pass architectures, will also struggle without increased cost and/or complexity.

Typically, registration sensitivity for conventional marking engines is reduced through the use of rotated screens. However, this approach becomes less effective and vulnerable to moiré as the number of colorants and required screens increases, and this may defeat benefits of using hypochromatic colorants.

SUMMARY

Ideally, existing 4 color CMYK (cyan, magenta, yellow, and black) halftone screen solutions could be leveraged to provide up to 8 color CcMmYyKk solutions (where cmyk are light hypochromatic versions of these same colors), without requiring the design of new screen solutions or suffering from increased registration sensitivity. This can be achieved by pairing together a dark colorant with it's hypochromatic version into a combined screen solution using tri-level xerography.

Xerographic devices generally have a maximum ink limit set as part of a color management scheme. During the xerographic process, individual layers, such as Cyan, Magenta, Yellow and Black (CYMK) are laid down separately in an overlapping fashion. If the collective total toner pile height becomes too thick, the toner mass may smear during fusing. In order to prevent this stress on the fuser from the excessively thick toner, there is an ink limit set for each pixel, such as, for example, 280, expressed as a percentage of area coverage. This limit attempts to ensure that the sum of all ink components (CYMK, etc.) does not exceed a certain threshold. For example, a certain color in a color gamut may require 70 cyan, 75 magenta, 80 yellow, and 65 black units. Because the sum of these color components exceeds the set limit of 280, this overlay will not be reproducible because it exceeds the ink limit. When using additional colorants, for example light hypochromatic colorants such as light cyan or light magenta, the ink limit problem is further compounded as now there are 5, 6 or more colorants that collectively must be under the ink limit. Thus, while an increase in the number of color separations would presumably enlarge the reproducible gamut and improve print quality, factors such as ink limit and registration errors could have the opposite effect, respectively. In particular, using light colorants on an ink-limited device can significantly decrease peak saturation capability if colors overlap inefficiently.

For example, using conventional rotated halftone screens as shown in FIG. 10, a 50% dark cyan separation combined with 50% light cyan produces an overlay that is composed of 25% dark cyan only, 25% light cyan only, 25% both, and 25% neither. Half of the light cyan is covered by dark cyan and is completely ineffective. The only effective part is shown on the right in FIG. 11. Wasting area coverage on ink-limited machines can decrease the size of the realizable gamut.

Tri-level processes have been used successfully in various commercial products, such as the Xerox 4850 and 4890 highlight color printers, to reproduce black along with a highlight or spot color. Similar tri-level processes have been described for use in full color copiers. Details of these tri-level processes can be found, for example, in U.S. Pat. No. 5,155,541 to Loce et al., U.S. Pat. No. 5,337,136 to Knapp et al., U.S. Pat. No. 5,895,738 to Parker et al., U.S. Pat. No. 6,163,672 to Parker et al., U.S. Pat. No. 6,188,861 to Parker et al., and U.S. Pat. No. 6,203,953 to Dalal, and U.S. patent application Ser. No. 11/692,411, all assigned to Xerox Corporation and hereby incorporated by reference herein in their entireties.

The basics of tri-level processing use a single photoreceptor and a multi-level writing exposure, resulting in two image regions, one a charge area developable (CAD) region and the other a discharge area developable (DAD) region. An advantage of this architecture is that it is possible to achieve perfect, risk-free dot-on-dot registration pair-wise, between a first colorant and a second colorant.

In accordance with aspects of the disclosure, the tri-level process is used to achieve excellent color-to-color registration using a conventional colorant, such as CYMK, and its hypochromatic partner (such as light cyan, light magenta, light yellow, or light black (gray)).

In accordance with exemplary embodiments, a four drum, six plus color process having a tandem architecture is used. Developer units include full strength and reduced strength (light) hypochromatic partner toners of Cyan, Magenta, Yellow, and Black (CYMK). However, the disclosure is applicable to other configurations and not limited to this.

In various embodiments, image processing is performed so that low to mid-tone portions of the tone reproduction curve (TRC) are produced solely by the second hypochromatic color toner and higher portions of the TRC are produced by non-overlapping combinations of the first color toner and/or the second hypochromatic color toner. This increases the total surface area coverage by maximizing usage of the lighter colorant, which provides a smoother image.

In other embodiments, the tri-level xerographic process forms white border regions between the first and second color toners.

BRIEF DESCRIPTION OF THE DRAWINGS

Exemplary embodiments will be described with reference to the attached drawings, in which like numerals represent like parts, and in which:

FIG. 1 is an example of a related art involving hypochromic printing using rotated screens.

DETAILED DESCRIPTION OF EMBODIMENTS

Figure 1:
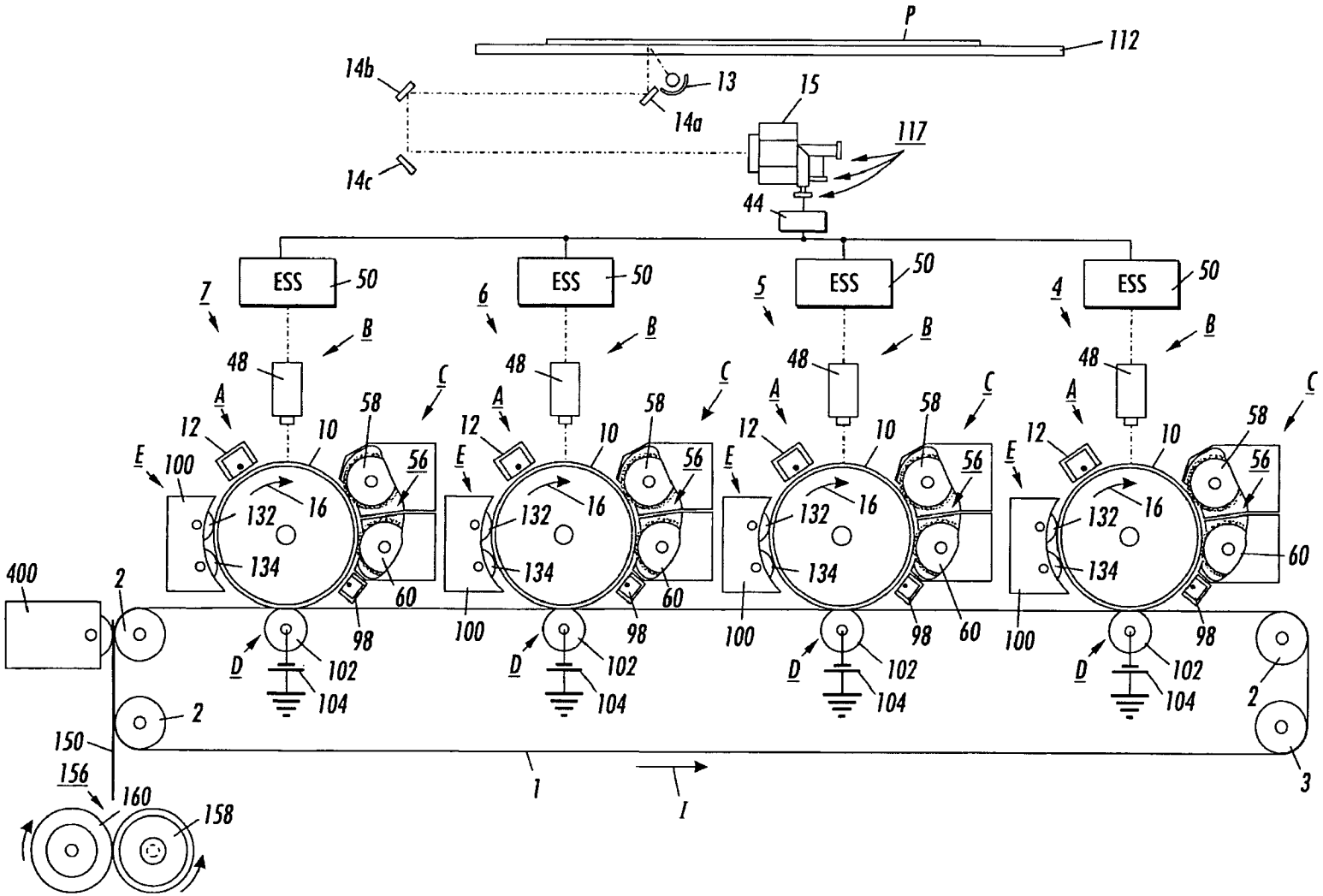
FIG. 1 is an illustration of an exemplary xerographic machine including a plurality of tri-level xerographic imaging units, at least one of which includes a full strength toner and a reduced strength toner of the same color.

A first embodiment of the disclosure will be described with reference to FIGS. 1-4. The basic xerographic system is shown and described in FIG. 1. This may be a tandem architecture suitable for high-speed production color printing. Each photoreceptor develops two separations in tri-level mode. While they may be combined in different ways, the color separations are developed onto the various photoreceptors and then transferred to a compliant intermediate member, such as a belt or drum. When all four separations have been built up on the intermediate member, the entire image is transfixed to paper. An optional film forming station can be used to spread out the toner image into a thin film before it is transfixed to paper.

Although described with reference to a digital color copy system, aspects of the disclosure could be used in a digital printing process in which a digital input original is derived from a computer application.

In operation of the multicolor xerographic machine illustrated, a computer generated color image may be inputted into image processor unit 44 or a color document P to be copied may be placed on the surface of a transparent platen 112. A scanning assembly having a light source 13 illuminates the color document 10. The light reflected from the color document P may be reflected by mirrors 14*a*, 14*b* and 14*c*, through lenses (not shown) and a dichroic prism 15 to three charged-coupled devices (CCDs) 117 where the information is read. The reflected light can then be separated into three primary colors by the dichroic prism 15 and the CCDs 117. Each CCD 117 outputs an analog voltage, which is proportional to the strength of the incident light. The analog signal from each CCD 117 is preferably converted into a multi-bit digital signal for each pixel (picture element) by an analog/digital converter. The digital signal enters image processor unit 44. The output voltage from each pixel of the CCD 117 is stored as a digital signal in the image-processing unit. The digital signal, which represents the blue, green, and red density signals is converted in the image processing unit into bitmaps in a suitable color space, such as CYMK, which includes bitmaps for yellow (Y), cyan (C), magenta (M), and black (K). The bitmap represents the color value for each pixel of the image.

As illustrated in FIG. 1, the xerographic machine includes an intermediate belt 1 entrained about a plurality of rollers 2 and 3 and adapted for movement in the direction of the arrow I. Belt 1 is adapted to have transferred thereon a plurality of toner images, which are formed using a plurality of tri-level image forming devices or engines 4, 5, 6 and 7. Each of the engines 4, 5, 6 and 7 can be identical except for the color of toners associated with each developer unit of the engine. Engine 4 includes a charge retentive member in the form of a photoconductive drum 10 constructed in accordance with well known manufacturing techniques. The drum is supported for rotation in the direction of arrow 16 such that its surface moves past a plurality of xerographic processing stations in sequence.

As shown in FIG. 1, initially successive portions of the drum 10 pass through charging station A. At charging station A, a corona discharge device indicated generally by the reference numeral 12, charges the drum 10 to a selectively high uniform potential, $V_0$. The initial charge decays to a dark decay discharge voltage, $V_{CAD}$.

Next, the charged portions of the photoreceptor surface are advanced through an exposure station B. At exposure station B, the uniformly charged photoreceptor or charge retentive surface 10 is exposed to a scanning device 48 that causes the charge retentive surface to be discharged in accordance with the output from the scanning device. Preferably the scanning device is a three level laser Raster Output Scanner (ROS), but could be a LED image bar or other known or subsequently developed scanning device. Inputs and outputs to and from the ROS 48 are controlled by an Electronic Subsystem (ESS) 50. The ESS may also control the synchronization of the belt movement with the engines 4, 5, 6 and 7 so that toner images are accurately registered with respect to previously transferred images during transfer from the latter to the former.

Figure 4A:
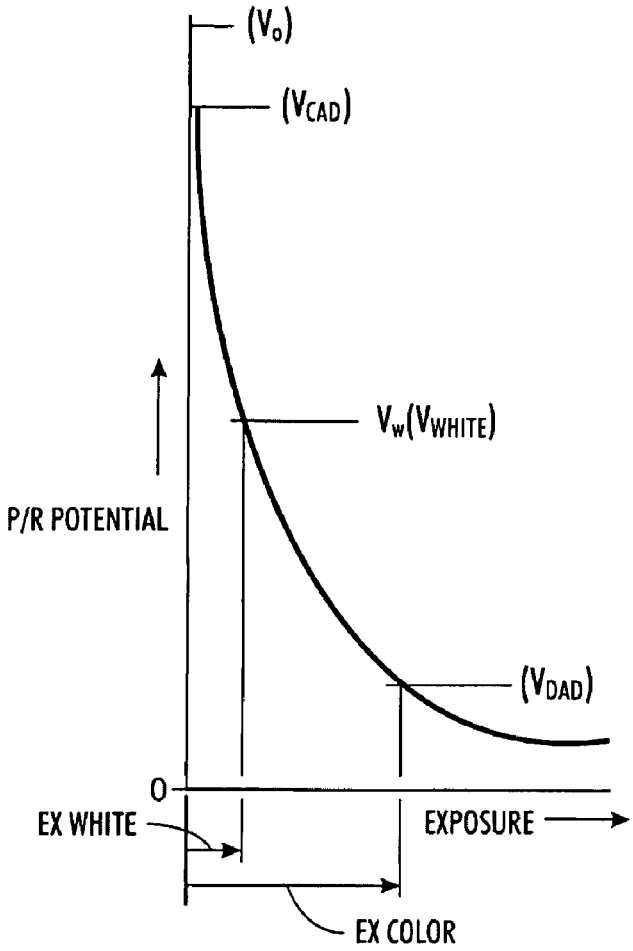
FIG. 4A is an illustration of a discharge curve of a tri-level electrostatic image.

As shown in FIG. 4A, a tri-level electrostatic image may be formed using an initial voltage $V_0$, an unexposed dark discharge potential $V_{CAD}$, a white or background level discharge level $V_W$, and a photoreceptor residual potential (full exposure) $V_{DAD}$ using the raster output scanner (ROS).

At a development station C, a magnetic brush or other development system, indicated generally by the reference numeral 56 advances developer materials, such as toner, into contact with the electrostatic latent images on the photoconductor. The development system 56 may include two developer units 58 and 60 having magnetic brush developer roll structures.

Each roller advances its respective developer material into contact with the latent image. Appropriate developer biasing is accomplished via power supplies not shown that are electrically connected to respective developer structures 58 and 60. Color discrimination in the development of the electrostatic latent image is achieved by passing the photoreceptor past the two developer structures 58 and 60 in a single pass with the rollers thereof electrically biased to voltages that are offset from the background voltage $V_W$, the direction of offset depending on the polarity of toner in the housing.

Developer unit 58 in engine 4 uses a first color toner, having triboelectric properties (i.e., negative charge) such that it is driven to the least highly charged areas at the potential $V_{DAD}$ of the latent images by the electrostatic development field between the photoreceptor and the development rolls of structure 58. This roll may be biased using a chopped DC bias via power supply, not shown.

The triboelectric charge of the toner contained in the magnetic brush developer used by the second developer unit 60 in engine 4 is chosen so that a second color toner is deposited on the parts of the latent image at the most highly charged potential $V_{CAD}$ by the electrostatic development field existing between the photoreceptor and the development structure. This roll, like the roll of the structure 58, may also be biased using a chopped DC bias in which the housing bias applied to the developer housing is alternated between two potentials, one that represents roughly the normal bias for the DAD developer, and the other that represents a bias that is considerably more negative than the normal bias. In exemplary embodiments, the first color is a normal CYMK colorant and the second colorant is a lighter hypochromatic partner colorant, such as cyan and light cyan as a pair.

Because the composite image developed on the photoreceptor consists of both positive and negative toner, a negative pretransfer dicorotron member 98 at the pretransfer station D is provided to condition the toner for effective transfer to a substrate using positive corona discharge. At a transfer station D, an electrically biased roll 102 contacting the backside of the intermediate belt 1 serves to effect combined electrostatic and pressure transfer of toner images from the photoconductive drum of engine 4 to the belt 1.

A DC power supply 104 of suitable magnitude is provided for biasing the roll 102 to a polarity, in this case negative, so as to electrostatically attract the toner particles from the drum to the belt. After the toner images created using engine 4 are transferred from photoconductive surface of drum 10, the residual toner particles carried by the non-image areas on the photoconductive surface are removed therefrom. These particles are removed at cleaning station E. A cleaning housing 100 supports therewithin two cleaning brushes 132, 134 supported for counter-rotation with respect to the other and each supported in cleaning relationship with photoreceptor drum 10. Each brush 132, 134 is generally cylindrical in shape, with a long axis arranged generally parallel to photoreceptor drum 10, and transverse to photoreceptor movement direction. Brushes 132, 134 each have a large number of insulative fibers mounted on a base, each base respectively journaled for rotation (driving elements not shown). The brushes are typically detoned using a flicker bar and the toner so removed is transported with air moved by a vacuum source (not shown) through the gap between the housing and photoreceptor drum 10, through the insulative fibers and exhausted through a channel, not shown. A typical brush rotation speed is 1300 rpm, and the brush/photoreceptor interference is usually about 2 mm. Brushes 132, 134 beat against flicker bars (not shown) for the release of toner carried by the brushes and for effecting suitable tribo charging of the brush fibers.

After all of the toner images have been transferred from the engines 4, 5, 6 and 7, the composite image is transferred to a final substrate 150, such as plain paper, by passing through a conventional transfer device 400, which forms a transfer nip with roller 2. The substrate 150 may then be directed to a fuser device 156, such as a heated roll member 158 and a pressure roll member 160, which cooperate to fix the composite toner image to the substrate.

Figure 2:
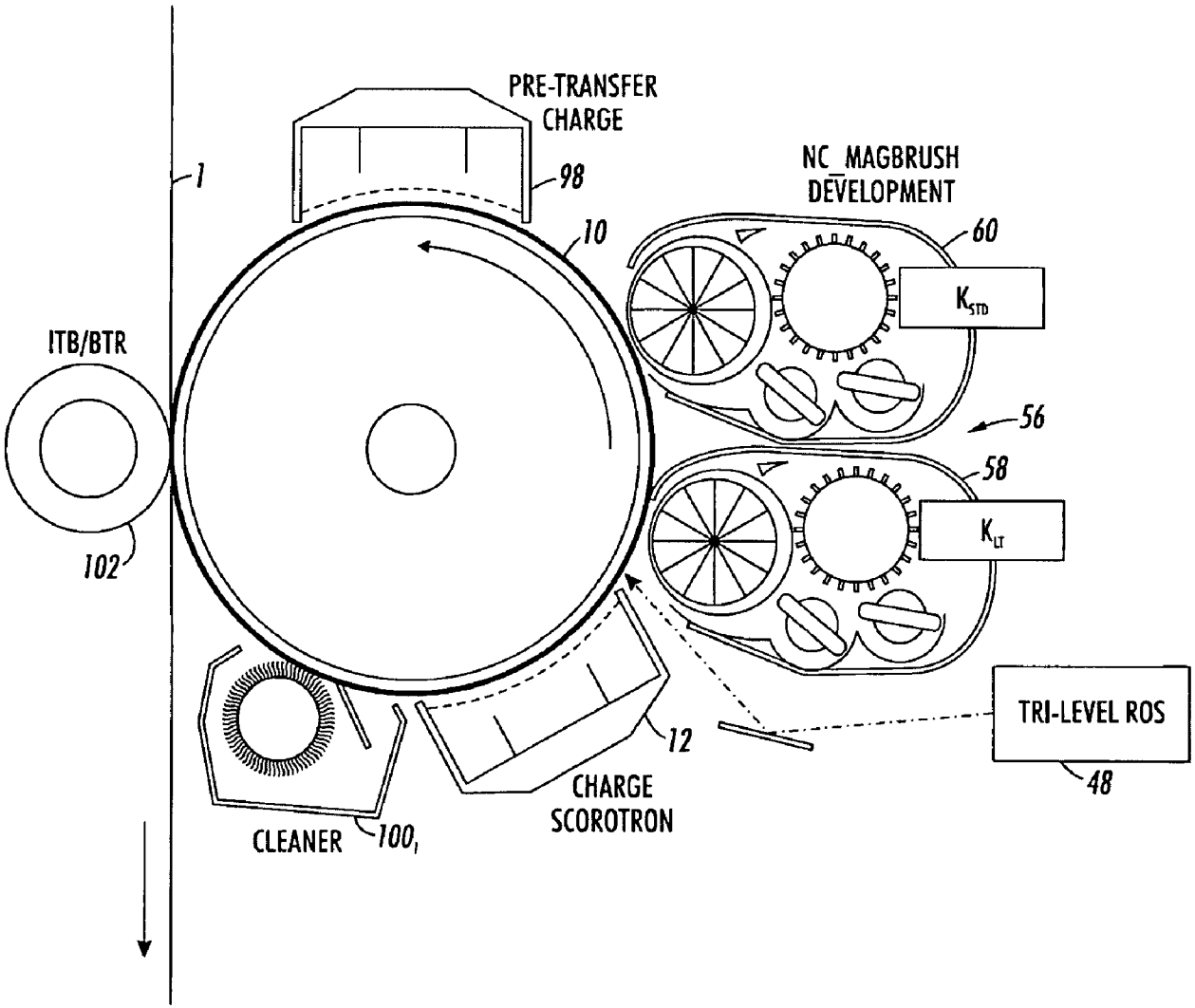
FIG. 2 is an illustration of an exemplary xerographic imaging unit from the system of FIG. 1.
Figure 3:
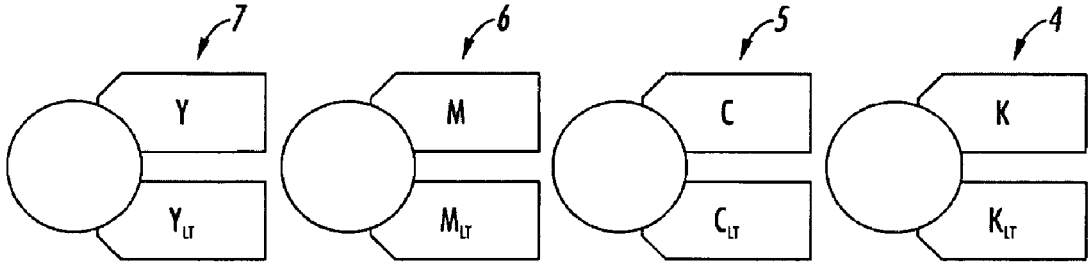
FIG. 3 is a simplified illustration of developer units according to a first embodiment of a 4-drum, 8-color xerographic machine in which the developer units includes a full strength and a hypochromatic partner toner for each of CYMK toners.

Specific details of a first embodiment of the disclosure will be described with reference to FIG. 2. This aspect uses the tri-level process with at least one xerographic imaging unit 4, 5, 6, or 7 containing a pairing of a regular colorant toner (such as CYM or K) and a hypochromatic partner (lighter colorant form of the regular colorant). In its simplest form, the xerographic machine can be a monochrome copier with a single color capability, having a single photoreceptor, and a single xerographic imaging unit as shown in FIG. 2. However, in exemplary embodiments, the xerographic machine may be a full color printing system such as the one presented in FIG. 1, in which each of developer systems 4-7 includes one of Cyan, Magenta, Yellow and Black colorant in one developer unit while the other complementary developer unit includes a hypochromatic partner colorant including one of light Cyan, light Magenta, light Yellow, and light Black (gray).

Referring back to FIG. 2, the first colorant may be a full strength cyan toner (C) within a first developer unit of the xerographic imaging unit, such as developer unit 60. The second colorant may be a light cyan toner $C_{LT}$ within a second developer unit 58 of the xerographic imaging unit. Because of the specific tri-level process, in which a background level (white) is provided so that the voltage sweeps from light to white to dark as described in more detail below with respect to FIGS. 4A and 4B, enhanced registration is enabled between the cyan and light cyan colorants because it is not possible for the colorants to overlap. These colorants are intentionally paired together as light and dark strength color components. For example, in the preferred embodiment shown in FIGS. 7A-H, the highlight range is generated using exclusively the light colorant, as indicated in FIGS. 7A through 7D. The full strength colorant is useful for reproducing mid-tone levels of density through to the shadow densities, as indicated in FIGS. 7E through 7H. This is accomplished by increasing the area coverage of the dark colorant while reducing the coverage of the lighter colorant. Notice that the dark colorant uses a dot-on-dot halftoning methodology. That is, the dark and light colorants both use the same haftone frequencies and angles, but are offset in phase so that the lattice of dots from the dark colorant grow from within the lattice of holes of the light colorant. In this way, each and every screen design taken from an existing halftone solution can be leveraged to produce an additional complementary solution for another separation. That is, any rotated screen angle assigned to any color can be exploited for imaging two colors, the original color and it's hypochromatic version. In this way, every 4-color rotated screen solution can be leveraged to produce up to an 8-color rotated screen solution by applying the approach shown in FIGS. 7A-7H.

Color discrimination in the development of the electrostatic latent image is achieved when passing the photoreceptor through the two developer housings in tandem or in a single pass by electrically biasing the housings to voltages which are offset from the background voltage $V_w$, the direction of offset depending on the polarity or sign of toner in the housing. For example, the first colorant may be cyan having positively charged triboelectric properties such that the toner is driven to the most highly charged areas ($V_{CAD}$) of the latent image by the electrostatic field between the photoreceptor and the development rolls biased at $V_{bb}$ as shown. Conversely, the negative triboelectric charge on the light colorant (light cyan) is chosen so that the toner is urged towards parts of the image at residual potential $V_{DAD}$ by the electrostatic field existing between the photoreceptor and the development rolls biased to $V_{CB}$.

Figure 4B:
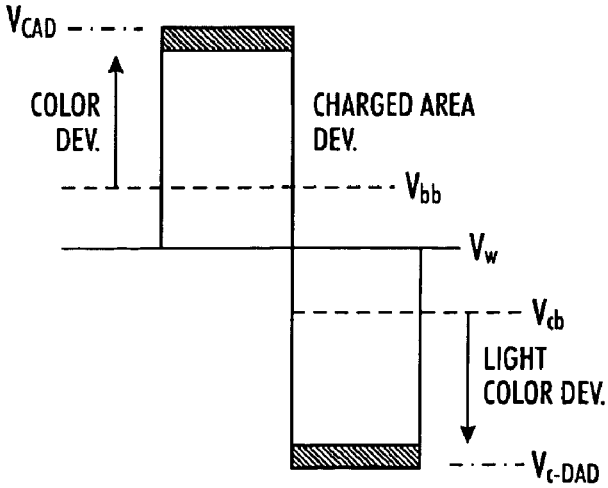
FIG. 4B is a plot of photoreceptor potentials for a tri-level electrostatic image.

As best shown in FIGS. 4A and 4B, by using a voltage range having a sweep that transitions from light colorant at one extreme to white in the center (no colorant) and dark colorant at the other extreme, overlap between colors is strictly prohibited, as there is always a white separation region between color transitions. This eliminates waste associated with overlapping separations of similar color to minimize problems due to ink-limit constraints. In addition, this minimizes instability associated with color transitions, as illustrated in FIG. 8 where minimized regions of instability corresponding to FIGS. 7A-7H are shown. Transitions from one color to another are sensitive to voltage noises, and limited rise and fall times associated with changes in exposure. To minimize these transition areas, the dark and light colorants share the exact same transition areas, as shown in FIG. 8. These shared areas accomplish two objectives: 1) it improves quality by reducing the total region of instability because pairs of colors can share a region of instability instead of having each separation contribute it's own region, and 2) any instability is partially offset by pairing dark and light colorants together. That is, shifts in voltage and exposure are likely to exchange some areas intended to be a dark color to end up being a light color instead, or visa versa. This partially offsets the effect of the noise because the errors only impact a density change, not a total absence of the intended color. Moreover, because of the independence and lack of overlap, the two partner colors do not have a cumulative effect on the ink limit.

That is, while CYMK separations may overlap to form the composite image (with each layer's contribution adding to the threshold ink limit for toner pile height to avoid fusing stress), the extra hypochromatic colorants do not further contribute because they do not overlap with their complementary full strength colorant. Thus, although there may be eight process color combinations, at most four colors overlap. Accordingly, the full gamut that is reproducible with a conventional 4-color xerographic CYMK machine can be reproduced with a 8-color xerographic machine using tri-level xerography without further concern over ink limit.

Figure 9:
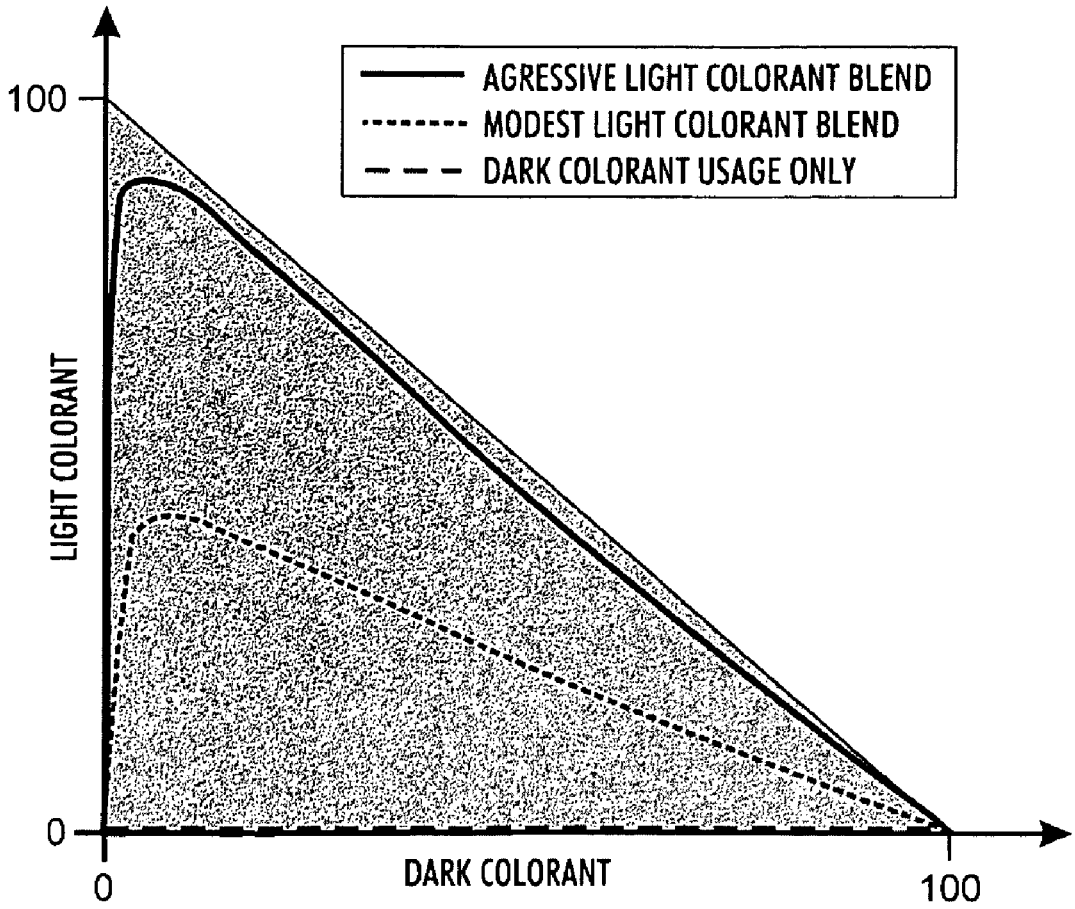
FIG. 9 represents three distinct blending strategies enabled by a dot-on-dot tri-level methodology.
Figure 10:
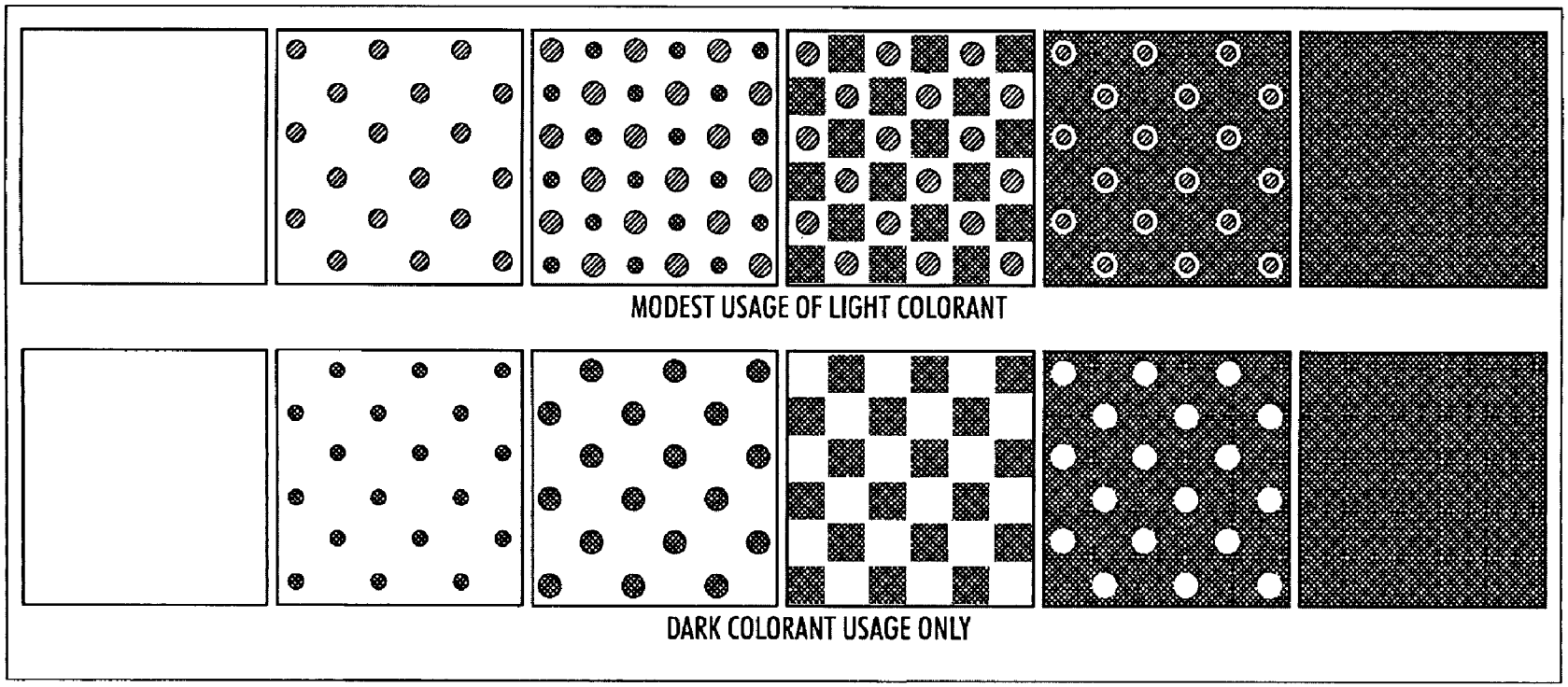
FIG. 10 illustrates two additional blending strategies supported by the disclosure.

That is, independent control of the light and dark colorants combined with the ability to avoid undesirable overlap is a unique combination of this design that guarantees that the influence of the ink-limit is minimized, and gamut loss is completely avoidable. To appreciate this, FIG. 9 shows three distinct blending strategies exemplified by this disclosure. However, a variety of curves connecting the origin to 100% dark colorant in FIG. 9 can be valid blending strategies. That is, any curve in the shaded area connecting the origin to 100% dark can be a valid blending curve. The black, dotted and dashed curves show aggressive, modest and zero usage of the light colorant, respectively. The dark curve illustrates the blending strategy of FIG. 7A-H, with heavy usage of the light colorant, followed by a mid-tone to shadow region with the light-dark colorant sum being close to 100%. The dotted curve shows a more modest blending strategy that uses less light colorant, and the dashed line shows a strategy that uses the dark colorant exclusively. The modest and exclusive blending strategies are illustrated in FIG. 10.

The only way to guarantee that gamut is not lost is to retain the capability of reducing the usage of the light colorant. If the color to be generated is close to the ink-limit, then a modest blending strategy that uses limited amounts of light colorant must be used. This is illustrated by the top of FIG. 10, and by the dotted curve on FIG. 9. This guarantees that the required saturation is reached (so that color is realizable), and the ink-limit is not exceeded. If the color to be generated is on the extreme edge of the gamut, then use of the light colorant is strictly prohibited because the lighter colorant use would either reduce saturation, darkness, or exceed the ink-limit. In this case, the dark colorant is used exclusively, as shown in the bottom of FIG. 10, and represented by the dashed curve of FIG. 9. Separate control of the dark and light colorants guarantees that a family of blending alternatives is available. This will allow for the ability to maximize smoothness, retain the entire gamut, and avoid exceeding the ink-limit at every point within the gamut.

Figure 11:
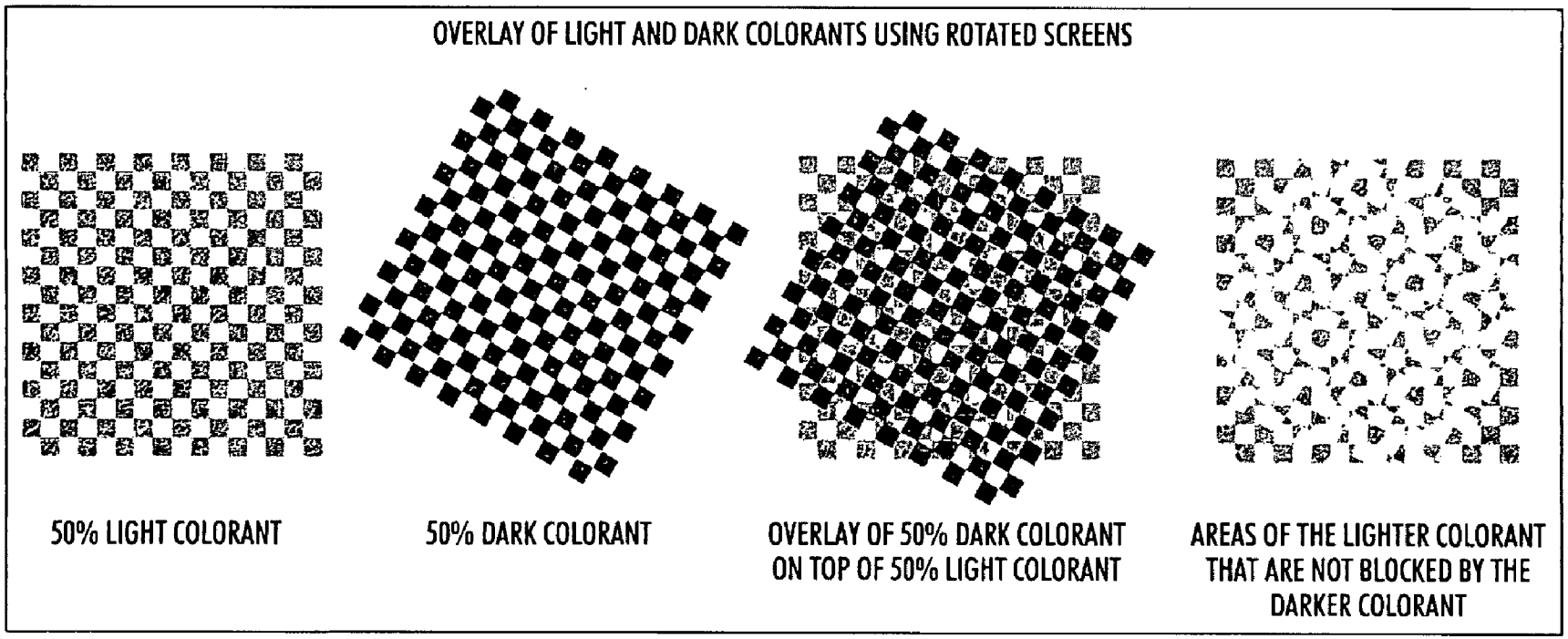

Notice that this level of flexibility is not available for a related tri-level xerographic approach illustrated in FIG. 11. In FIG. 11, every dark dot cluster must be surrounded by an annulus of light colorant which is developed at an intermediate level of exposure. The dark colorant can't be used exclusively, so any machine that employs the technology illustrated in FIG. 11 would surrender gamut because it would always be forced to use less effective light colorant, even on color combinations that are on the edge of the realizable gamut, because their required dark-colorant sum is close to or equal to the ink-limit.

An exemplary development process would include a non-contact magnetic brush development system. This approach should provide low noise development capability due to the reduced interaction. Additionally, it can result in a compact size due to its high development efficiency as demonstrated on various commercial products incorporating such a development system. An exemplary magnetic brush development system can be found in U.S. Pat. No. 6,295,431 to Mashtare, the disclosure of which is hereby incorporated herein by reference in its entirety.

In tri-level xerography, two distinct colorants are developed together. In the past, this technology was used successfully for highlight color applications, such as black with a custom highlight color, such as red. The tri-level technology ensures perfect registration. Aspects of the disclosure take this technology and apply it to application of hypochromatic colorants to achieve a specific dot-on-dot halftoning methodology that improves smoothness of light critical areas while alleviating ink-limit stress.

Figure 7:
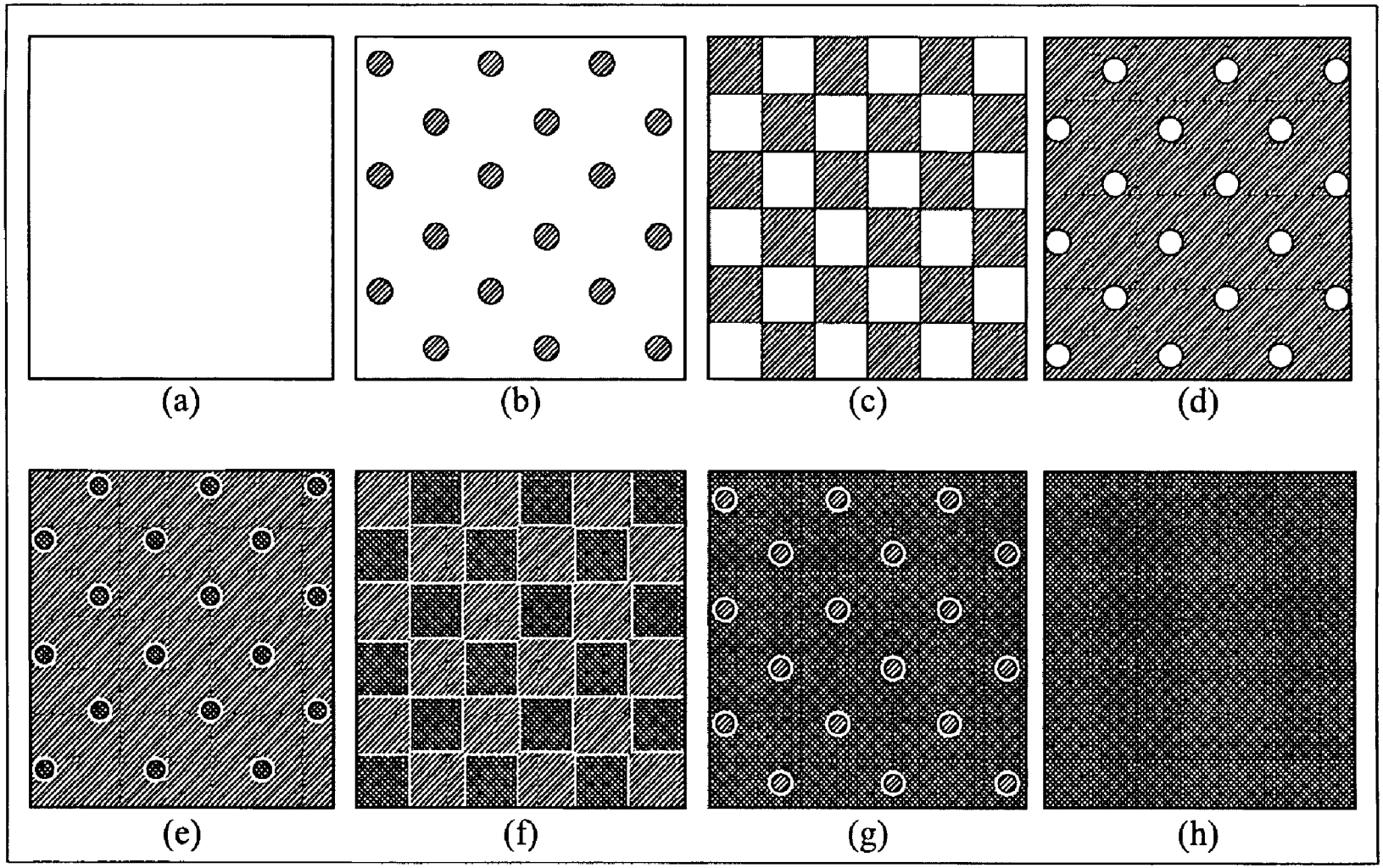
FIGS. 7A-H illustrate a progression of dot-on-dot halftoning using tri-level xerography according to an exemplary embodiment of the disclosure.
Figure 8:
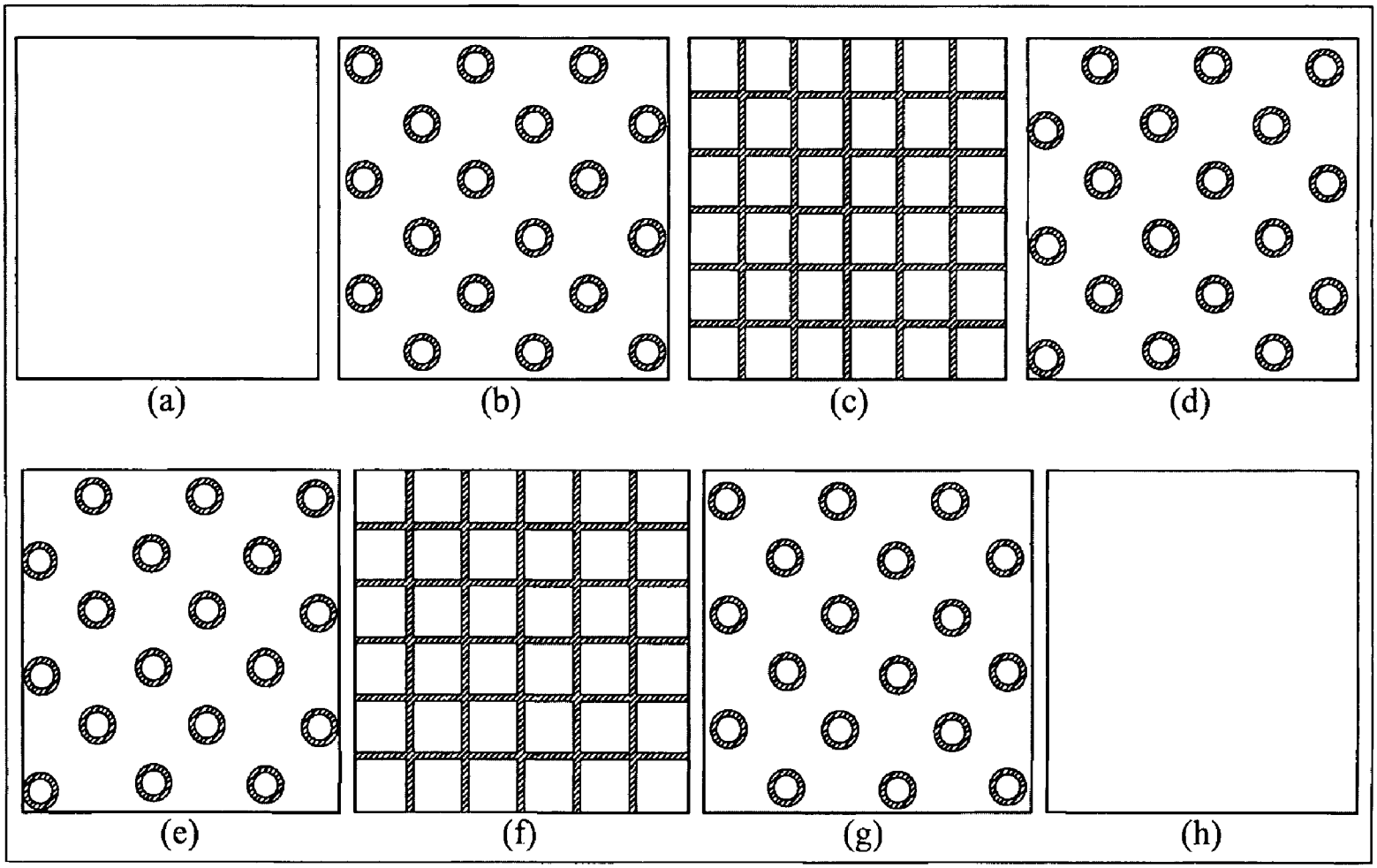
FIG. 8 corresponds to FIGS. 7A-H and shows minimized regions of instability.

In FIGS. 7A-H, light colorant (hypo chromic colorant) is used exclusively to produce the highlight end of the range of the color halftoning as shown in FIGS. 7A-7D. Thus, if the cyan were used to reproduce a sky, light cyan would be used for the lower levels of saturation in increasing area coverage until the level of FIG. 7D is reached. Higher levels of saturation are achieved by growing dots using the darker cyan colorant, such as from inside of the holes left behind in an otherwise filled area of the light colorant. These holes and dots are grown together to produce the sweep from FIGS. 7E-7H. Finally, the remaining levels of the light colorant are plugged with dark colorant to produce the shadows, ending with the pattern in FIG. 7H in which a solid is formed using solely the cyan colorant. This basic xerographic machine is not limited to monochrome applications, but can be augmented with one or more additional developer housings to achieve full color printing. A family of less aggressive dot-on-dot blending strategies as suggested by FIG. 9 may also be used. The blending strategy of FIG. 7A-H is one embodiment of this family of blending strategies, and corresponds to the dark curve of FIG. 9. Two additional embodiments of this family are illustrated in FIG. 10, and they correspond to the gray and dotted curves of FIG. 9. The availability of this family of blending strategies helps to establish that any given ink-limit can be satisfied without suffering any loss in gamut.

Figure 6A:
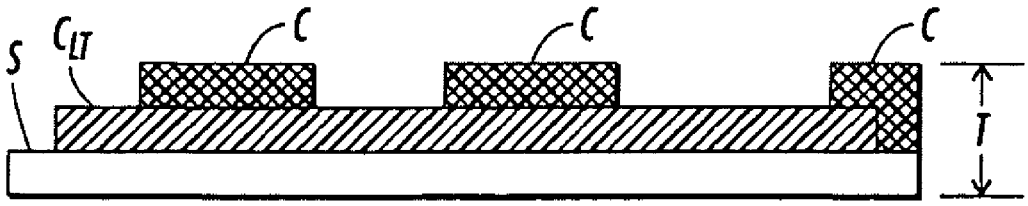
FIG. 6A is a representative example of dropmass affecting toner pile height when the hypochromatic layer is allowed to overlap the darker color.
Figure 6B:
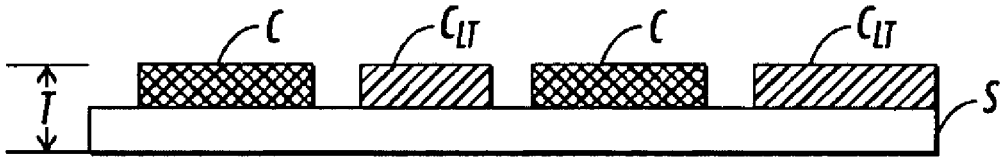
FIG. 6B is a representative example of how toner pile height can be reduced when using a specific tri-level xerography process from that of FIG. 6A.

This methodology of halftone screening has advantages over other forms of halftoning. For example, in a related art, each colorant is applied as an independent overlapping separation, and dot designs employ different angles (to include frequencies) to achieve the required blends by overlapping area coverage, as illustrated graphically in FIG. 11, and represented in FIG. 6A. However, this is a much less efficient and effective strategy because the darker colors are applied after the lighter colors are applied. Thus, for example, if 75% dark cyan (C) and 20% light cyan ($C_{LT}$) area coverage (AC) is desired, then dark cyan is required to provide exactly 75% AC, but light cyan is required to cover 80%. This is because using rotated dots, the light colorant needs to guarantee that 20% out of the remaining 25% is covered. However, out of the applied 80% of light cyan area coverage, 60% of that coverage is wasted because it overlaps with the darker color and is covered over.

Besides wasting consumables, this necessitated overlap causes other problems. Overlapping colorants of the same hue do not significantly contribute to the desired document appearance, but do contribute to the stress associated with fusing, because both colorants are contributing to the ink-limit budget. That is, because overlapping coverage is necessary, an additional thickness and mass of ink is required, which increases fusing demands. If cyan alone were used as described in the previous example, it would require a total AC of 155% (75% for dark, and 80% for light). If a xerographic engine has an ink-limit of around 280% (a typical ink-limit specification), then the cyan blend alone already accounts for 155% of the 280% total, well over one-half of the ink-limit. The remaining blends of light and dark magenta, black, and yellow combined are limited to a remaining ink-limit budget of 125% (280−155). Thus, even though extra colorants are available, many combinations of these colorants are likely to exceed ink limits by having a toner pile height sum that exceeds the ink limit, resulting in a reduction of gamut possibilities.

Figure 5:
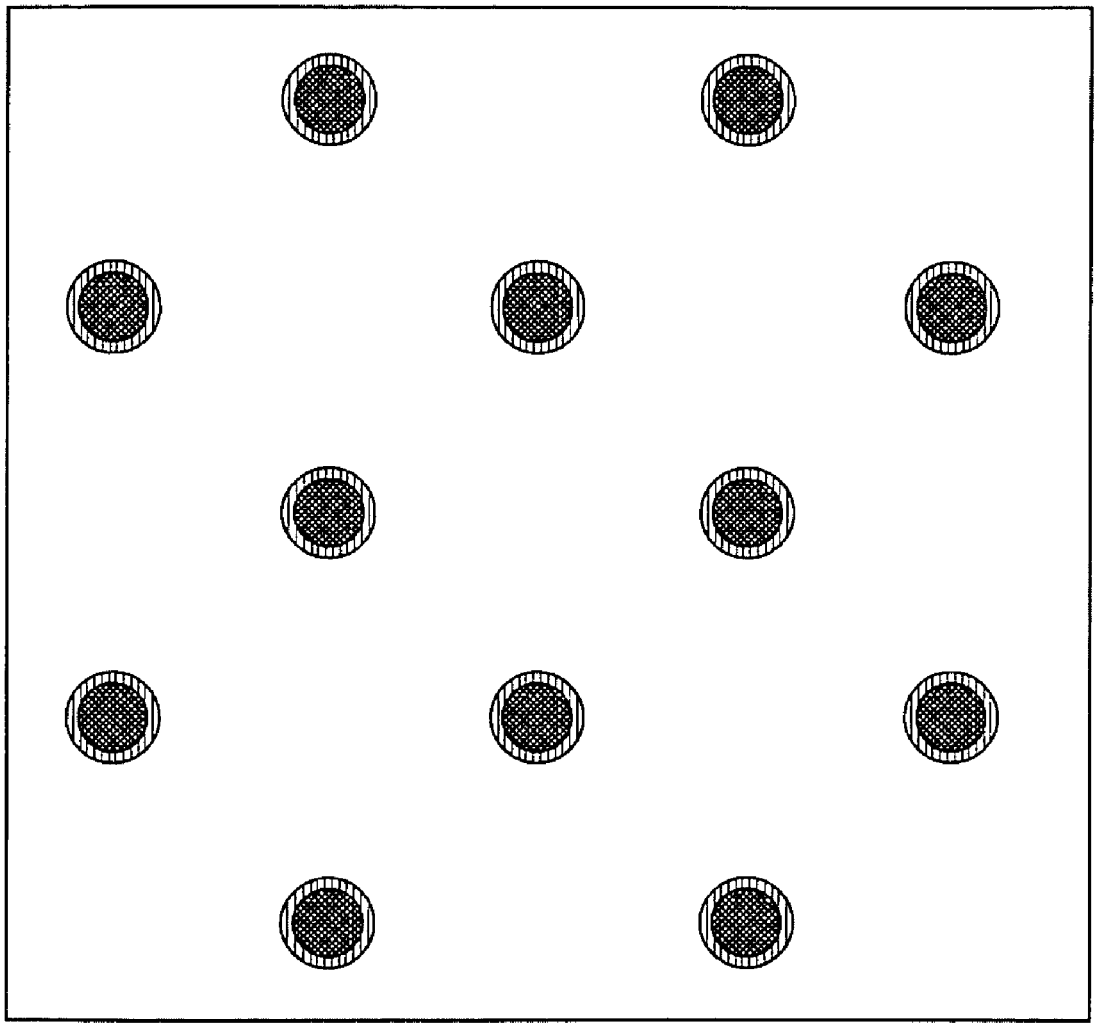
FIG. 5 (RELATED ART)
FIG. 5 is an example of a related art usage of tri-level printing.

A similar problem with gamut reduction may occur in the xerographic machine described in U.S. patent application Ser. No. 11/692,411 which uses a variation of tri-level development, but specifically provides a modified sweep that transitions from white to light colorant to dark colorant. This is represented in FIG. 5 and forces the laying down of light colorant coverage to achieve darker points of the TRC as shown. That is, a dark colorant must be applied over top of the lighter colorant as shown. Besides being less efficient from a usage standpoint because the underlying lighter colorant does not greatly contribute to saturation levels, the overlap does stress the fuser and may result in toner pile heights that exceed ink limits. This may result in color gamut reductions. Also, the hardware configuration may result in noisy transitions.

However, using tri-color xerography techniques, 75% dark cyan AC and 20% light cyan AC coverage can be applied directly because the separations can be maintained separate and independent. This technology ensures that overlapping dark and hypochromatic colorants is avoided, reducing toner pile heights and problems with ink limit. Thus, combining tricolor xerography with hypochromatic colorants can provide the efficiency necessary to avoid loosing gamut. In addition, it increases the extent to which hypochromatic colors can be used to achieve smoothing, which is a competitive advantage over prior techniques which transition to usage of dark colorants lower in the TRC. That is, by increasing usage of lighter colorants, more surface area can be covered for a smoother appearance. Moreover, such techniques result in decreased fusing demands.

In accordance with an exemplary embodiment, the xerographic machine is a full-color, four drum, 8 color tandem architecture device having four xerographic imaging units 4, 5, 6, and 7. Each xerographic imaging unit includes a single photoreceptor and a tri-level developer unit pair composed of a full strength colorant and a corresponding hypochromatic colorant. However, various other possibilities and combinations exist. For example, because yellow already is a light density colorant, it may not be necessary to provide a reduced strength yellow colorant. Accordingly, this extra developer unit could be replaced with another colorant.

It will be appreciated that various of the above-disclosed and other features and functions, or alternatives thereof, may be desirably combined into many other different systems or applications. For example, with suitable efficient design and photoreceptors, these disclosed architectures could provide viable digital production color copiers capable of improved graphic image quality and gamut and may be suitable for use in tightly integrated parallel printing (TIPP) system platforms. Also, various presently unforeseen or unanticipated alternatives, modifications, variations or improvements therein may be subsequently made by those skilled in the art, and are also intended to be encompassed by the following claims.

What is claimed is:

1. A xerographic printing method, comprising:

uniformly charging a photoreceptor of a tri-level xerographic imaging unit to a predetermined voltage;

creating tri-level electrostatic images including CAD image areas and DAD image areas having different voltage levels, $V_{CAD}$ and $V_{DAD}$, respectively, on the photoreceptor, where a background discharge level $V_W$ is located between $V_{CAD}$ and $V_{DAD}$ in which no image may be developed;

developing one of the CAD image areas and DAD image areas with a first toner of a first color and developing the other of the CAD image areas and DAD image areas with a second toner of a second color that is a hypochromatic light form of the first toner to form a composite separation image of a desired image in which the first and second colors are developed without any overlap; and transferring the first composite separation image onto a substrate.

2. The xerographic printing method of claim 1, wherein the first and second colors are selected from one of the following sets of colorants: (a) cyan and light cyan; (b) yellow and light yellow; (c) magenta and light magenta; and (d) black and gray.

3. The xerographic printing method of claim 1, further comprising using at least two tri-level xerographic imaging units, the second xerographic imaging unit including a third toner of a color different from the first toner and a corresponding fourth toner that is a hypochromatic light form of the third toner.

4. The xerographic printing method of claim 3, further comprising using three tri-level xerographic imaging units, the first xerographic imaging unit comprising cyan and light cyan toners, the second xerographic imaging unit comprising yellow and light yellow toners, and the third xerographic unit comprising magenta and light magenta toners.

5. The xerographic printing method of claim 1, further comprising using four tri-level xerographic imaging units, the first xerographic imaging unit comprising cyan and light cyan toners, the second xerographic imaging unit comprising yellow and light yellow toners, the third xerographic unit comprising magenta and light magenta toners, and the fourth xerographic unit comprising black and gray toners.

6. The xerographic printing method of claim 1, further comprising image processing the image so that low to mid-tone portions of the tone reproduction curve (TRC) are produced solely by the second hypochromatic color toner and higher portions of the TRC are produced by non-overlapping combinations of the first color toner and/or the second hypochromatic color toner.

7. The xerographic printing method of claim 6, further comprising applying a near maximum area coverage of colorant for a given location on the TRC by maximizing the use of the lighter colorant.

8. The xerographic printing method of claim 1, further comprising:

adjusting a blending curve of the first color toner and second hypochromatic color toner to avoid gamut loss or ink-limit violation.

9. The xerographic printing method of claim 1, further comprising forming of white border regions between the first and second color toners.

10. A xerographic machine, comprising:

a photoreceptor; and a tri-level xerographic imaging unit including a charging device for charging the photoreceptor to a predetermined voltage;

an imaging system for obtaining tri-level electrostatic images including CAD image areas on the photoreceptor having a first voltage level $V_{CAD}$, and DAD image areas on the photoreceptor having a second voltage level $V_{DAD}$ lower than the first voltage level, and a background discharge level $V_W$ between the first and second voltage levels at which neither the CAD image areas nor the DAD image areas may be developed; and first and second developer units for developing the CAD image areas and the DAD imaging areas with a first colorant toner of a first color from one of the developer units and a second colorant toner that is a hypochromatic light form of the first colorant toner from the other of the developer units, wherein one of the toners is developed in the CAD image areas and the other toner is developed in the DAD image areas to form a first composite color separation of a desired image in which the first and second toners are developed without any overlap.

11. The xerographic machine according to claim 10, wherein the first and second colors are selected from one of the following sets of colorants: (a) cyan and light cyan; (b) yellow and light yellow; (c) magenta and light magenta; and (d) black and gray.

12. The xerographic machine according to claim 10, further comprising using at least two tri-level xerographic imaging units, the second xerographic imaging unit including a third toner of a color different from the first toner and a corresponding fourth toner that is a hypochromatic light form of the third toner.

13. The xerographic machine according to claim 10, further comprising using three tri-level xerographic imaging units, the first xerographic imaging unit comprising cyan and light cyan toners, the second xerographic imaging unit comprising yellow and light yellow toners, and the third xerographic unit comprising magenta and light magenta toners.

14. The xerographic machine according to claim 10, further comprising using four tri-level xerographic imaging units, the first xerographic imaging unit comprising cyan and light cyan toners, the second xerographic imaging unit comprising yellow and light yellow toners, the third xerographic unit comprising magenta and light magenta toners, and the fourth xerographic unit comprising black and gray toners.

15. The xerographic machine according to claim 10, wherein the xerographic imaging unit processes the image so that low to mid-tone portions of the tone reproduction curve (TRC) are produced solely by the second hypochromatic color toner and higher portions of the TRC are produced by non-overlapping combinations of the first color toner and/or the second hypochromatic color toner.

16. The xerographic machine according to claim 10, wherein the xerographic imaging unit applies a near maximum area coverage of colorant for a given location on the TRC by maximizing the use of the lighter colorant.

17. The xerographic machine according to claim 10, further comprising:

an adjustment mechanism that adjusts a blending curve of the first color toner and second hypochromatic color toner to avoid gamut loss or ink-limit violation.

18. The xerographic machine according to claim 10, wherein the xerographic imaging unit forms white border regions between the first and second color toners.

19. A xerographic printing method, comprising:

uniformly charging a photoreceptor of a tri-level xerographic imaging unit to a predetermined voltage;

creating tri-level electrostatic images including CAD image areas and DAD image areas having different voltage levels, $V_{CAD}$ and $V_{DAD}$, respectively, on the photoreceptor, where a background discharge level $V_W$ is located between $V_{CAD}$ and $V_{DAD}$ in which a white border region is produced;

developing one of the CAD image areas and DAD image areas with a first toner of a first color and developing the other of the CAD image areas and DAD image areas with a second toner of a second color that is a hypochromatic light form of the first toner to form a composite separation image of a desired image in which the first and second colors are developed without any overlap; and transferring the first composite separation image onto a substrate.

20. The xerographic method according to claim 19, further comprising image processing the image so that low to mid-tone portions of the tone reproduction curve (TRC) are produced solely by the second hypochromatic color toner and higher portions of the TRC are produced by non-overlapping combinations of the first color toner and/or the second hypochromatic color toner.

21. The xerographic method according to claim 20, further comprising applying a near maximum area coverage of colorant for a given location on the TRC by maximizing the use of the lighter colorant.

22. The xerographic method according to claim 19, further comprising:

adjusting a blending curve of the first color toner and second hypochromatic color toner to avoid gamut loss or ink-limit violation.

23. The xerographic method according to claim 19, wherein the first and second colors are selected from one of the following sets of colorants: (a) cyan and light cyan; (b) yellow and light yellow; (c) magenta and light magenta; and (d) black and gray.

* * * * *